US008011635B2

(12) United States Patent
Aleo

(10) Patent No.: US 8,011,635 B2
(45) Date of Patent: Sep. 6, 2011

(54) ADJUSTABLE WALL-HANGER ASSEMBLY

(76) Inventor: Dino D. Aleo, Windsor (CA)

( * ) Notice: Subject to any disclaimer, the term of this patent is extended or adjusted under 35 U.S.C. 154(b) by 16 days.

(21) Appl. No.: 12/616,411

(22) Filed: Nov. 11, 2009

(65) Prior Publication Data

US 2010/0116964 A1 May 13, 2010

Related U.S. Application Data

(60) Provisional application No. 61/198,922, filed on Nov. 12, 2008.

(51) Int. Cl.
*A47G 1/24* (2006.01)

(52) U.S. Cl. ..... 248/476; 248/205.1; 248/217.4

(58) Field of Classification Search ..... 248/475.1, 248/476, 477, 495, 496
See application file for complete search history.

(56) References Cited

U.S. PATENT DOCUMENTS 1,071,428 A * 8/1913 Jones ..... 248/448
1,107,686 A * 8/1914 Mehrmann ..... 248/495
2,681,194 A * 6/1954 Halvorsen ..... 248/495
4,907,773 A * 3/1990 Menchetti et al. ..... 248/287.1
5,069,411 A * 12/1991 Murphy ..... 248/476
5,342,014 A * 8/1994 Wilson ..... 248/476
5,584,462 A * 12/1996 Reese ..... 248/477
6,003,825 A * 12/1999 Abernathy, Jr. ..... 248/478
6,032,378 A * 3/2000 Null ..... 33/613
6,299,123 B1 * 10/2001 Hayde ..... 248/476
6,637,608 B1 * 10/2003 Schneider ..... 211/90.02
6,666,425 B1 12/2003 Ferguson ..... 248/477
6,739,065 B2 * 5/2004 Hofmeister et al. ..... 33/613
6,971,184 B2 * 12/2005 Prevost ..... 33/613
7,155,840 B1 * 1/2007 Carbonaro ..... 33/613
7,201,357 B2 4/2007 Price et al. ..... 248/477

* cited by examiner

*Primary Examiner* — Terrell McKinnon
*Assistant Examiner* — Daniel J Breslin
(74) *Attorney, Agent, or Firm* — Bliss McGlynn, P.C.

(57) ABSTRACT

An adjustable wall-hanger assembly comprises a hanger adapted to be secured to a wall and defining an opening, a body section, an upper section, a top level, and a bottom level. A hanger slide is mounted to the hanger, is adapted to slide continuously in a substantially horizontal or vertical direction in the opening, and defines a slot extending in substantially the other of the horizontal or vertical direction. A mounting fastener is received through the slot and adapted to slide continuously therealong and be fastened to the wall to mount the assembly thereto. A combination of the continuous horizontal and vertical sliding of the hanger slide and mounting fastener allows for substantially infinite placement of the mounting fastener in the opening. A hanger hook is fixedly connected to and extends outwardly from the hanger and substantially overlies the opening for supporting an object hung on the hanger hook.

8 Claims, 2 Drawing Sheets

ADJUSTABLE WALL-HANGER ASSEMBLY

REFERENCE TO RELATED APPLICATION

This application claims benefit to U.S. Provisional Patent Application 61/198,922 filed Nov. 12, 2008 and entitled "Perfect-Placement Adjustable Wall-Hanger Assembly."

BACKGROUND OF INVENTION

1. Field of Invention

The invention relates, generally, to a wall hanger and, more particularly, to such a hanger that is adjustable.

2. Description of Related Art

Various adjustable wall hangers are known. Each such hanger generally is adapted to be attached to a surface of a vertical wall for adjustably hanging or suspending wall décor—such as pictures, photographs, paintings, mirrors, collectibles, calendars, and corresponding frames—on the wall surface.

For example, U.S. Pat. No. 7,201,357 discloses a vertically adjustable wall hanger that comprises a hanger and a hanger mount. The hanger includes a main hanger body, a first set of serrations defined in side-to-side spaced relation to one another on a back side of the main hanger body, and a center slot defined and a hanging hook provided on the main hanger body. The hanger mount includes a main mount body having a second set of serrations defined on a body face positioned in side-to-side spaced relation and sized and shaped similar to and confronting the first set of serrations. The second set of serrations is located on a back side of the main mount body with the main mount body defining a screw hole confronting the center slot on the main hanger body. A center hanger mount is held in the main mount body positioned in co-axial alignment with the center slot provided in the main hanger body. The hanger and hanger mount are assembled together by meshing the respective serrations in the first and second sets of serrations in a pre-selected position to accommodate corresponding positioning requirements of a user of the device. A mounting screw extends through the main hanger body and center hanger mount in clamped abutting assembly with each other to hold the hanger and hanger mount in superimposed lapped engagement with each other in the pre-selected position.

Also, U.S. Pat. No. 6,666,425 discloses a vertically adjustable wall hanger comprising a main body—which is securable to a vertical surface with mounting screws, nails, or other similar fasteners—and an adjustable bracket. The main body defines a pair of mounting apertures and is generally symmetrical about a plane passing through axes defined by the mounting apertures. The main body also includes a vertically oriented linear ratchet having a plurality of teeth and a pair of parallel, outwardly-facing, spaced-apart peripheral tracks or grooves. Each of the tracks is open at a top of the main body. The adjustable bracket includes a pair of cylindrical locator pins that enter the tracks at the top of the main body and slide within them. The adjustable bracket includes also a pawl that engages the linear ratchet. The locator pins allow the adjustable bracket to be rotated upwardly so that the pawl may be disengaged from the linear ratchet, the adjustable bracket moved up or down, and the pawl re-engaged with the linear ratchet.

However, these and other of the known adjustable wall hangers do not perfectly place/align the wall décor or corresponding frame on the wall surface. More specifically, they do not adjust in two ways to accommodate imperfections of the wall décor or corresponding frame and/or construction of the wall surface. They do not adjust in also a continuous manner. Rather, they adjust in a discrete, incremental manner.

Thus, there is a need in the related art for an adjustable wall hanger that perfectly places/aligns the wall décor or corresponding frame on the wall surface. More specifically, there is a need in the related art for a wall hanger that adjusts in two ways to accommodate imperfections of the wall décor or corresponding frame and/or construction of the wall surface. There is a need in the related art for a wall hanger that adjusts in also a continuous—rather than a discrete, incremental—manner.

SUMMARY OF INVENTION

The invention overcomes the problems in the related art in an adjustable wall-hanger assembly comprising a hanger adapted to be secured to a wall and defining an opening of an interior of the hanger, a body section and an upper section extending from the body section, and a top level and a bottom level that are substantially opposed and spaced from and substantially identical with each other such that a space is defined between the levels and the levels are connected with each other along at least one of a closed exterior edge and at least one corner defined by the body section. A hanger slide is mounted to the hanger, is adapted to slide continuously in a substantially horizontal or vertical direction in the opening of the hanger, and defines a slot of an interior of the hanger slide extending in substantially the other of the horizontal or vertical direction with respect to the hanger slide. A mounting fastener is received through the slot of the hanger slide and adapted to slide continuously along the slot and be fastened to the wall to mount the assembly to the wall. A combination of the continuous substantially horizontal and vertical sliding of the hanger slide and mounting fastener allows for substantially infinite placement of the mounting fastener in the opening of the hanger. A hanger hook is fixedly connected to and extends outwardly from the hanger and substantially overlies the opening of the hanger for supporting an object hung on the hanger hook.

An advantage of the adjustable wall-hanger assembly of the invention is that it perfectly places/aligns the object—such as a picture, photograph, painting, mirror, collectible, calendar, or corresponding frame—on the wall.

Another advantage of the adjustable wall-hanger assembly of the invention is that it adjusts in two ways (horizontal and vertical) to accommodate imperfections of the picture, photograph, painting, mirror, collectible, calendar, or corresponding frame and/or construction of the wall.

Another advantage of the adjustable wall-hanger assembly of the invention is that it adjusts in a continuous—rather than a discrete, incremental—manner.

Another advantage of the adjustable wall-hanger assembly of the invention is that it can be manufactured simply and inexpensively and in high volume using low-cost materials—such as high-performance nylon and polycarbonate—and processes—such as injection molding.

Another advantage of the adjustable wall-hanger assembly of the invention is that it can be easily operated by a person who needs to make a quick and accurate placement of the picture, photograph, painting, mirror, collectible, calendar, or corresponding frame (especially a group of same) on an indoor or outdoor wall of a building with a minimum of difficulty.

Another advantage of the adjustable wall-hanger assembly of the invention is that it is reusable, versatile, recyclable, and eco-friendly.

Another advantage of the adjustable wall-hanger assembly of the invention is that it can be universally used—such as in residential and commercial applications; on an object utilizing a wire-, keyhole-, d-ring-, sawtooth-, step-, or general-hole application; and on drywall.

Another advantage of the adjustable wall-hanger assembly of the invention is that it has a robust design, with some parts thereof able to be made of aluminum and/or steel, and is virtually unbreakable.

Other objects, features, and advantages of the adjustable wall-hanger assembly of the invention will be readily appreciated as the same becomes better understood while reading the subsequent detailed description of embodiments of the assembly taken in conjunction with the accompanying respective drawings of such embodiments.

BRIEF DESCRIPTION OF EACH FIGURE OF DRAWING

DETAILED DESCRIPTION OF EMBODIMENTS OF INVENTION

An assembly for adjustably hanging an object to a wall according to the invention is generally indicated at 10, 110, 210 in FIGS. 1 through 6, where like numerals are used to designate like structure throughout the various embodiments of the assembly 10, 110, 210 disclosed herein. Although the assembly 10, 110, 210 is designed to be attached to a vertical wall for adjustably hanging or suspending wall décor—such as a picture, photograph, painting, mirror, collectible, calendar, or corresponding frame—on a surface of the wall, the assembly 10, 110, 210 is described below for adjustably hanging or suspending specifically a picture frame.

It should be appreciated by those having ordinary skill in the related art that the wall can have any suitable shape, size, structure, and texture and structural relationship with the assembly 10, 110, 210. It should be so appreciated also that the wall can be made of any suitable material—such as plaster and wood. It should be so appreciated also that the assembly 10, 110, 210 can be employed with a wall of any suitable structure. It should be so appreciated also that the assembly 10, 110, 210 can adjustably hang or suspend any suitable objects and not just those identified above. Details of each assembly 10, 110, 210 are described below with reference to FIGS. 1-2, 3-4, and 5-6, respectively.

Figure 1:
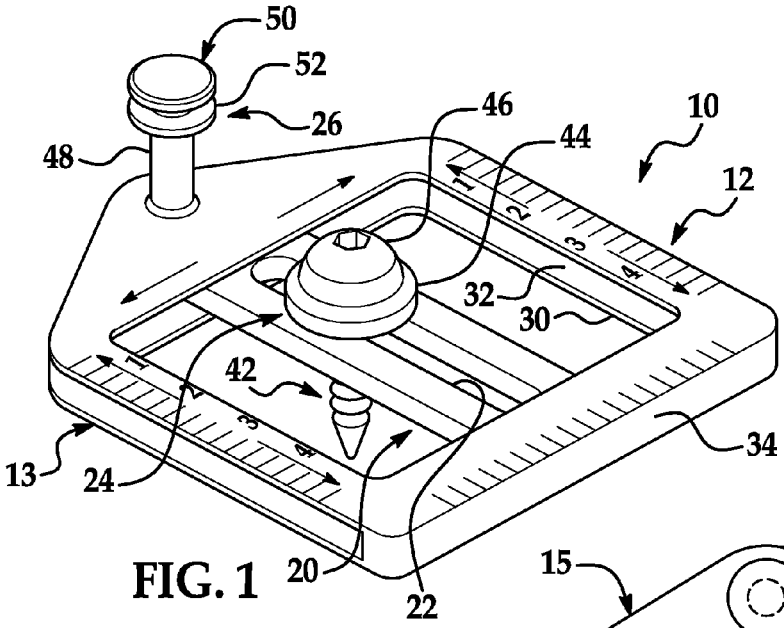
FIG. 1 is an elevated top perspective view of a first embodiment of an adjustable wall-hanger assembly according to the invention.
Figure 2:
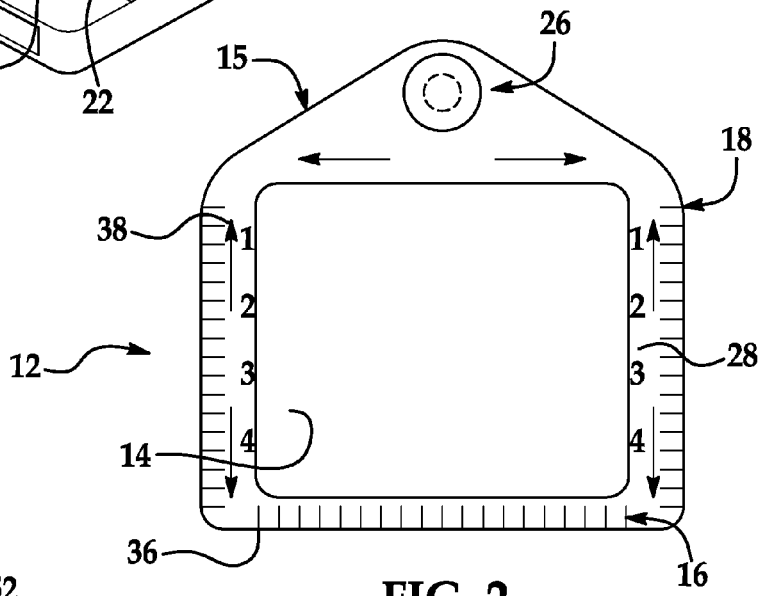
FIG. 2 is an elevated top view of a hanger of the first embodiment of the adjustable wall-hanger assembly according to the invention shown in FIG. 1.

Now with reference particularly to FIGS. 1-2, the assembly 10 comprises, in general, a hanger, generally indicated at 12, adapted to be secured to the wall (not shown) and defining an opening 14 of an interior of the hanger 12, a body section, generally indicated at 13, and an upper section, generally indicated at 15, extending from the body section 13. The hanger 12 defines also a top level 28 and a bottom level 30 that are substantially opposed and spaced from and substantially identical with each other such that a space 32 is defined between the levels 28, 30. The levels 28, 30 are connected with each other along a closed exterior edge 34 and/or at least one corner defined by the body section 13. A hanger slide, generally indicated at 20, is mounted to the hanger 12, is adapted to slide continuously in a substantially horizontal or vertical direction in the opening 14 of the hanger 12, and defines a slot 22 of an interior of the hanger slide 20 extending in substantially the other of the horizontal or vertical direction with respect to the hanger slide 20. A mounting fastener, generally indicated at 24, is received through the slot 22 of the hanger slide 20 and adapted to slide continuously along the slot 22 and be fastened to the wall to mount the assembly 10 to the wall. A combination of the continuous substantially horizontal and vertical sliding of the hanger slide 20 and mounting fastener 24 allows for substantially infinite placement of the mounting fastener 24 in the opening 14 of the hanger 12. A hanger hook, generally indicated at 26, is fixedly connected to and extends outwardly from the hanger 12 and substantially overlies the opening 14 of the hanger 12 for supporting the picture frame (not shown) hung on the hanger hook 26.

More specifically and as described in greater detail below, the hanger 12 defines also at least one horizontal distance scale, generally indicated at 16, and at least one vertical distance scale, generally indicated at 18. FIG. 1 shows the hanger slide 20 being adapted to slide continuously substantially horizontally in the opening 14 of the hanger 12. In turn, the slot 22 of the hanger slide 20 extends substantially vertically with respect to the hanger slide 20. The combination of the continuous substantially horizontal sliding of the hanger slide 20 and continuous substantially vertical sliding of the mounting fastener 24 allows for the substantially infinite placement of the mounting fastener 24 in the opening 14 of the hanger 12.

As shown in FIG. 2, the body section 13 defines a substantially square cross-section of the body section 13, and the upper section defines a substantially triangular cross-section of the upper section 15 (with respect to a plane defined by the page of the figure). The upper section 15 is substantially flush with and integrally extends from a top edge of the body section 13. The space 32 is substantially uniform and defined between the levels 28, 30. The levels 28, 30 are connected with each other exteriorly. The figure shows the levels 28, 30 being connected with each other along a closed exterior bottom edge 34 and bottom corners defined by the body section 13 and a remaining side exterior edge defined by the body section 13 being open.

The opening 14 of the hanger 12 defines a substantially square cross-section (with respect to a plane defined by the page of the figure) of the opening 14 and is defined substantially symmetrically in a substantially central volume of the body section 13 of the hanger 12 such that the levels 28, 30 and space 32 completely outline the opening 14. A single horizontal distance scale 16 is located along a bottom area of the top level 28, and a pair of vertical distance scales 18 are located along respective side areas of the top level 28. Each of the distance scales 16, 18 is identified by hash marks 36. In this way, the body section 13 defines a "Cartesian plane," wherein the horizontal distance scale 16 defines an x-direction of the assembly 10 and each vertical distance scale 18 defines a y-direction of the assembly. Each of the side areas of the top level 28 includes arrows 38 indicating corresponding "up" and "down" directions along the side area. Each of the corners of the hanger 12 is arcuate.

It should be appreciated by those having ordinary skill in the related art that the hanger 12, in general, can have any suitable shape, size, and structure. It should be so appreciated also that the opening 14 can have any suitable shape and size and structural relationship with the remainder of the hanger 12. It should be so appreciated also that each of the sections 13, 15 and levels 28, 30 can have any suitable shape, size, and structure and structural relationship with the remainder of the hanger 12. It should be so appreciated also that the sections 13, 15 and levels 28, 30 can be connected with each other in any suitable manner. It should be so appreciated also that each of the distance scales 16, 18 can use any suitable units—such as millimeters, centimeters, and/or inches—and have any suitable relationship with the remainder of the top level 28. It should be so appreciated also that the top level 28 can include a pair of horizontal distance scales 16 (as opposed to the single one thereof as shown in FIG. 2) and only a single vertical distance scale 18 (as opposed to the pair thereof as shown in FIG. 2). It should be so appreciated also that the hash marks 36 and arrows 38 can have any suitable shape and size and structural relationship with the remainder of the top level 28.

The hanger slide 20 defines a substantially rectangular cross-section (with respect to a plane defined by the page of the figure). A width of the hanger slide 20 is substantially less than that of the bottom edge 34 of the body section 13 of the hanger 12, and a length of the hanger slide 20 is substantially equal to that of the sides of the body section 13. End portions of the hanger slide 20 are securely fitted in the space 32 along, respectively, the top and bottom of the body section 13 such that the end portions are sandwiched between the levels 28, 30 of the hanger 12. In this way, the hanger slide 20 is adapted to slide continuously and smoothly in the opening 14 of the hanger 12 from an interior side of the body section 13 to the other interior side of the body section 13 until, say, an exterior edge of the hanger slide 20 or the mounting fastener 24 abuts a corresponding interior edge of the hanger 12. During such sliding, both sides of the hanger slide 20 remain substantially parallel with corresponding sides of the hanger 12. Each exterior corner of the hanger slide 20 is arcuate.

The slot 22 of the hanger slide 20 defines a substantially rectangular cross-section (with respect to a plane defined by the page of the figure) and is defined completely through the depth of and substantially symmetrical with a substantially central volume of the hanger slide 20. The width of the hanger slide 20 is significantly greater than that of the slot 22, and the width of the hanger slide 20 is significantly lesser than that of the body section 13. A longitudinal axis defined by the slot 22 is substantially parallel with the exterior sides of the hanger slide 20. Each interior corner of the hanger slide 20 is arcuate.

It should be appreciated by those having ordinary skill in the related art that the hanger slide 20, in general, can have any suitable shape, size, and structure and structural relationship with the hanger 12. It should be so appreciated also that the slot 22 can have any suitable shape and size and structural relationship with the remainder of the hanger slide 20. It should be so appreciated also that the hanger slide 20 can slide in any suitable manner for any suitable distance.

The mounting fastener 24 includes an assembly of a screw, generally indicated at 42, and a washer 44. The screw 42 is adapted to be inserted completely through the slot 22 from above the hanger slide 20 and screwed into the wall to mount the assembly 10 to the wall, and the washer 44 is operatively disposed between the hanger slide 20 and a head 46 of the screw 42. An outer diameter defined by each of the washer 44 and head 46 is greater than a width defined by the slot 22. As such, the washer 44 operatively contacts an upper surface of the hanger slide 20 and maintains the head 46 above the hanger slide 20. The mounting fastener 24 is adapted to slide continuously and smoothly in the slot 22 from an interior end of the hanger slide 20 to the other interior end of the hanger slide 20.

It should be appreciated by those having ordinary skill in the related art that the mounting fastener 24, in general, can have any suitable shape, size, and structure and structural relationship with the hanger slide 20. It should be so appreciated also that each of the screw 42 (including the head 46) and washer 44 can have any suitable shape, size, and structure and structural relationship with the remainder of the mounting fastener 24. It should be so appreciated also that the mounting fastener 24 can be any suitable fastener adapted to mount the assembly 10 to the wall. It should be so appreciated also that the mounting fastener 24 can slide in any suitable manner for any suitable distance.

As shown in FIG. 1, the hanger hook 26 includes a stem portion 48 and a head portion, generally indicated at 50, integrally disposed atop the stem portion 48. The stem portion 48 extends integrally outwardly a desired distance from a substantially central portion of the upper section 15 of the hanger 12, and the head portion 50 is adapted to support the picture frame hung on the hanger hook 26. More specifically, the head portion 50 defines a substantially uniform groove 52 extending completely about a substantially central portion of a circumferential surface of the head portion 50. When the assembly 10 is mounted to the wall, a substantially upper half of the groove 52 is adapted to operatively receive a part, say, a string or wire that is secured to the picture frame and used to hang the picture frame upon the assembly 10.

It should be appreciated by those having ordinary skill in the related art that the hanger hook 26, in general, can have any suitable shape, size, and structure and structural relationship with the hanger 12. It should be so appreciated also that each of the stem portion 48 and head portion 50 can have any suitable shape, size, and structure and structural relationship with the other. It should be so appreciated also that the groove 52 can have any suitable shape and size and structural relationship with the head portion 50. It should be so appreciated also that the stem portion 48 can extend any suitable distance from the hanger 12.

When it is desired to use the assembly 10, the user of the assembly 10 should determine where the picture frame to be hung is to be located on the wall surface. Although the assembly 10 can be used to hang a single picture frame, the assembly 10 is specially designed to be used to hang a plurality of picture frames in a pre-designed arrangement on the wall surface.

To this end, a location on the wall surface must be first chosen. Then, the picture frame is laid out on the wall, a desired spot is chosen, and a reference point is (or reference points are) marked with, say, a pencil. Then, the screw 42 is inserted through the slot 22 of the hanger slide 20 in such a way that the washer 44 is loosely positioned upon the hanger slide 20. At this point, a judgment is made about where the mounting fastener 24 is to be specifically located relative to the opening 14. Thereafter, the assembly 10 is adjusted by sliding the hanger 12 to the desired position with the hanger hook 26 being the hanging point, and the screw 42 is tightened to secure the assembly 10 to the wall. More specifically, the mounting fastener 24 quickly and simply is manually slid in the slot 22 and/or the hanger slide 20 is manually slid in the opening 14 until the mounting fastener 24 is moved to the specific location. The distance scales 16, 18 and arrows 38 can be used to assist in pinpointing this location. Then, the screw 42 is set into the wall to mount the assembly 10 to the wall. Finally, the picture frame is hung upon the hanger hook 26. In this way, the mounting fastener 24 is adjustable along both the x- and y-directions to provide perfect alignment/placement of the picture frame on the wall surface. Once the picture frame is hung, it is adjusted if necessary for perfect placement thereof, properly secured, and verified.

If desired, a threaded-screw receiving member (not shown) defining internal and external screw threads thereof can be used for engagement of the receiving member within the wall for receipt of the screw 42. Such a receiving member is generally known in the related art and used when the wall is made of a sufficiently soft material such that, without use of the receiving member, the load of the hung picture frame might cause the screw 42 to pull away from the wall. Of course, the screw 42 can be screwed into the wall without use of the receiving member. As an example, if the wall is wood paneling, it may not be necessary to use the receiving member.

As can easily be seen, use of the assembly 10 provides continuous two-direction adjustability of the picture frame and permits leveling, raising, or lowering of the picture frame from less than a millimeter to greater than fifty millimeters and perfect placement of the picture frame on the wall surface. Furthermore, the assembly 10 can accommodate wire, serrated metal clips, slotted holes, plates, and/or eyelets of the picture frame in any configuration. Moreover, the hanger hook 26 is designed for universal use and, all the while in operation, remains hidden from view.

Figure 3:
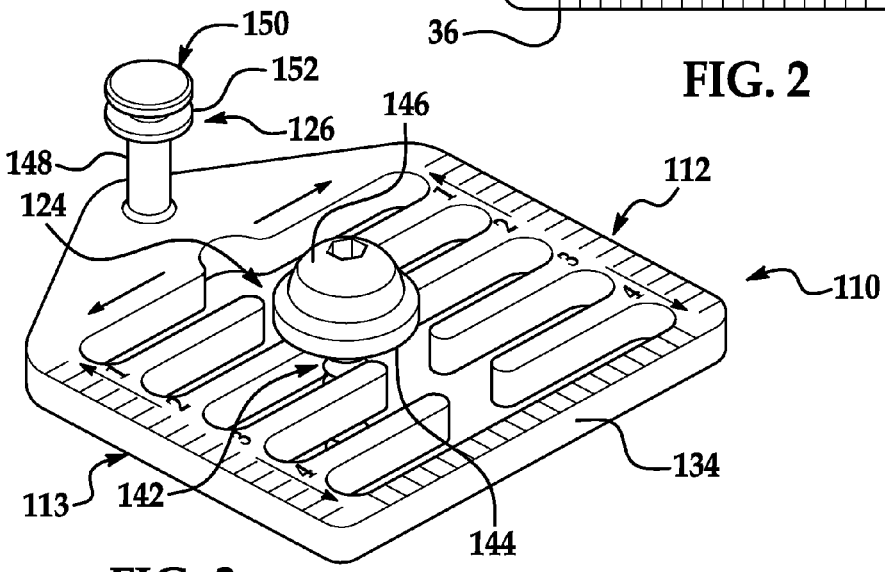
FIG. 3 is an elevated top perspective view of a second embodiment of the adjustable wall-hanger assembly according to the invention.
Figure 4:
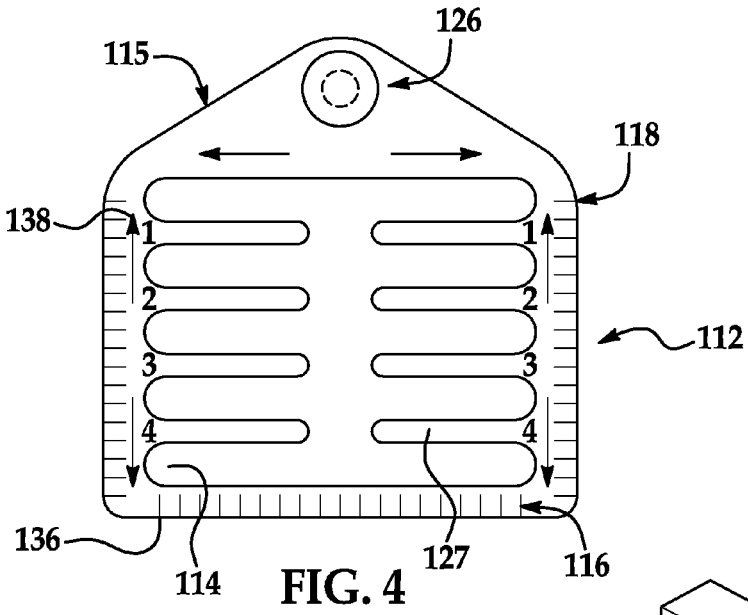
FIG. 4 is an elevated top view of a hanger of the second embodiment of the adjustable wall-hanger assembly according to the invention shown in FIG. 3.

Referring now to FIGS. 3 through 4, structure of the assembly 110 will be addressed. Parts of the assembly 110 corresponding to those of the assembly 10 have like reference numerals with respect to the assembly 10, but increased by one hundred (100). However, since structure relating to gliding of the mounting fastener 124 within the opening 114 vis-á-vis the structure relating to gliding of the mounting fastener 24 within the opening 14 is the only difference between the assembly 110 and the assembly 10, respectively, only this difference is described immediately below.

In this embodiment, as shown in FIGS. 3 through 4, the body section 113 of the hanger 112 defines at least one rib and, preferably, a plurality of ribs 127 integrally extending from at least one and, preferably, each interior side of the body section 113 into the opening 114. The figures show a first set of four ribs 127 extending from an interior side of the body section 113 and a second set of four ribs 127 extending from the other interior side of the body section 113 disposed opposite the first set for a total of eight ribs 127. The ribs 127 are substantially uniform with respect to each other, and the ribs 127 of each side are disposed substantially parallel and equidistantly with respect to each other and flush with the corresponding interior side.

A substantially equal amount of space is defined on either side of each rib 127, and a substantially equal amount of space is defined between free ends of respective opposed ribs 127. A substantially central portion of a bottom edge/side of the upper section 115 of the hanger 12 is indented such that a hemispherical space is formed between the body section 113 of the hanger 12 and the upper section 115. The mounting fastener 124 is adapted to be continuously and smoothly slid in the array of space and hemispherical space. The free end of each rib 127 is arcuate, and the interior side of the body section 113 adjacent each rib 127 is concave with respect to the opening 114.

With this structure, the mounting fastener 124 is securely fitted on either side of each rib 127 such that the washer 144 slidingly abuts a top surface of the corresponding ribs 127. The mounting fastener 124 can move in the opening 114 continuously and smoothly along the y-direction and continuously and smoothly along the x-direction at certain discreet distances from the bottom edge 134 of the body section 113. These distances will vary depending upon such variables as the diameter of the screw 142 and, thus, width of the spaces and diameter of the washer 144 and, thus, width of the ribs 127. Namely, within a given opening 114, the smaller the diameter of the screw 142 and, thus, width of the spaces and diameter of the washer 144 and, thus, width of the ribs 127, then greater is the number of ribs 127 and, thus, discrete distances from the bottom edge 134 at which the mounting fastener 124 can move continuously and smoothly along the x-direction.

It should be appreciated by those having ordinary skill in the related art that each of the ribs 127 can have any suitable shape, size, and structure and structural relationship with the remainder of the body section 113. It should be so appreciated also that the body section 113 can include any suitable number of ribs 127. It should be so appreciated also that each of the spaces can have any suitable shape and size and structural relationship with the remainder of the hanger 112.

As can easily be seen, each mounting fastener 24, 124 is adjustable along both the x- and y-directions. However, whereas the mounting fastener 24 can be securely positioned at any point in the opening 14, the mounting fastener 124 can be securely positioned only on either side of each rib 127. The assemblies 10, 110 are designed to be employed specifically with a picture-frame-and-picture combination weighing thirty or fewer pounds, such as generally is found in a home.

Figure 5:
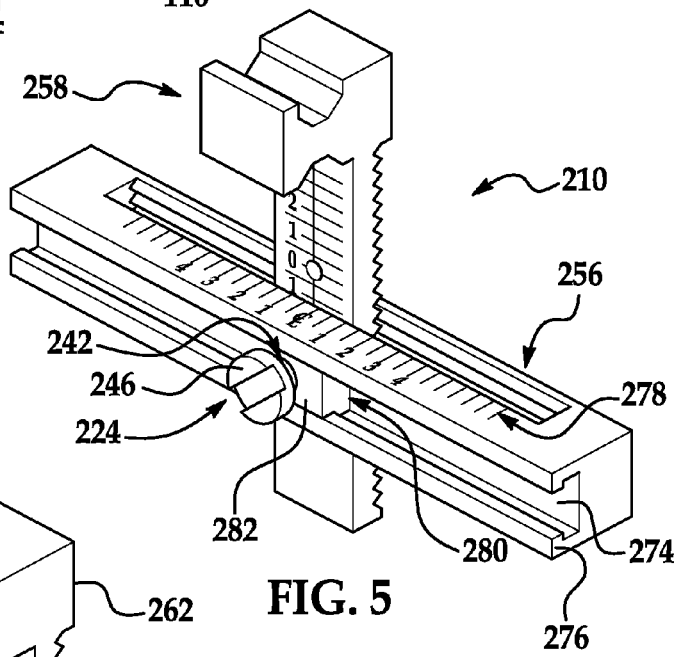
FIG. 5 is an elevated side perspective view of a first version of a third embodiment of the adjustable wall-hanger assembly according to the invention.
Figure 6:
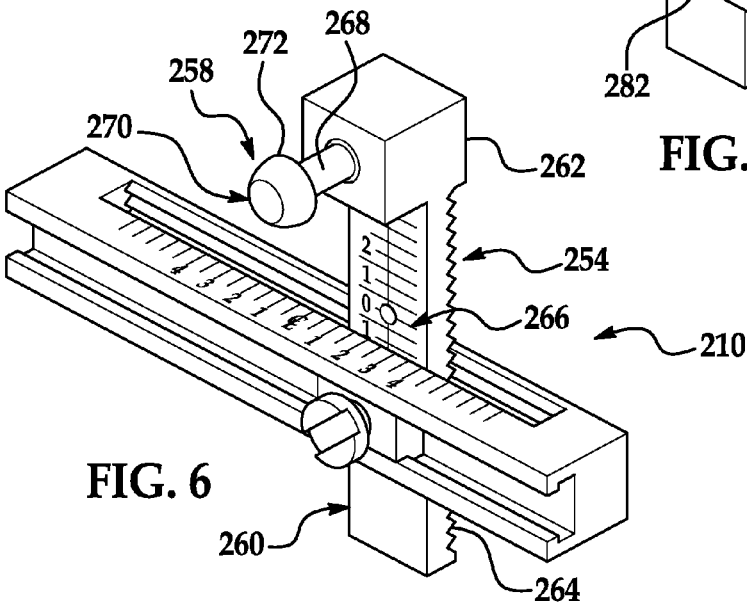
FIG. 6 is an elevated side perspective view of a second version of the third embodiment of the adjustable wall-hanger assembly according to the invention.

Referring now to FIGS. 5 through 6, structure of the assembly 210 will be addressed. Parts of the assembly 210 corresponding to those of the assembly 10 have like reference numerals with respect to the assembly 10, but increased by two hundred (200). The assembly 210 is designed to be employed specifically with a picture-frame-and-picture combination weighing one hundred or fewer pounds, such as generally is found in a gallery.

The assembly 210 includes a peg attachment, generally indicated at 254, a wall-mount bracket, generally indicated at 256, a hanger hook, generally indicated at 258, and a locking fastener, generally indicated at 224. The wall-mount bracket 256 operatively receives the peg attachment 254 such that the peg attachment 254 can slide substantially horizontally and vertically within the wall-mount bracket 256. The hanger hook 258 is adapted to support the picture frame hung on the hanger hook 258. The locking fastener 224 is adapted to fasten the peg attachment 254 in a desired position within the wall-mount bracket 256.

The peg attachment 254 includes a sliding part, generally indicated at 260, and a hanging part 262 integrally extending from an end of the sliding part 260. The sliding part 260 defines a substantially rectangular cross-section (with respect to a plane defined by the page of the figure), and the hanging part 262 is substantially box-shaped, wherein the end of the sliding part 260 integrally extends from a side of the hanging part 262. A face of the sliding part 260 defines a plurality of serrations 264 extending substantially horizontally across the face and adapted to assist in operatively holding the peg attachment 254 in place in relation to the wall-mount bracket 256. The serrations 264 are substantially uniform and disposed substantially parallel and equidistantly with respect to each other and flush with the edges of the sliding part 260. The other face of the sliding part 260 includes a vertical distance scale, generally indicated at 266, extending a substantial length of the other face.

The hanger hook 258 includes a stem portion 268 and a head portion, generally indicated at 270, integrally disposed atop the stem portion 268. The stem portion 268 extends integrally outwardly a desired distance from a substantially central portion of another side of the hanging part 262 and overlies the sliding part 260, and the head portion 270 is adapted to support the picture frame hung on the hanger hook 258. More specifically, in one version of the hanger hook 258, the head portion 270 defines a substantially uniform groove 272 extending completely about a circumferential surface of the head portion 270. When the assembly 210 is mounted to the wall, a substantially upper half of the groove 272 is adapted to operatively receive, say, a string or wire that is secured to the picture frame and used to hang the picture frame upon the assembly 210. In another version of the hanger hook 258, the head portion 270 does not define a groove. Rather, a top surface of the head portion 270 is substantially planar and defines a ledge. When the assembly 210 is mounted to the wall, the string or wire that is secured to the picture frame and used to hang the picture frame upon the assembly 210 rests upon the top surface of the head portion 270 and is restrained there by the ledge.

The wall-mount bracket 256 defines a substantially rectangular cross-section (with respect to a plane defined by the page of the figure) and an aperture (not shown) through which the sliding part 260 is adapted to slide. A front face of the wall-mount bracket 256 defines a track 274 extending the entire length of the front face and slidably supporting the locking fastener 224 within the track 274. An opposed pair of flanges 276 secures the locking fastener 224 within the track 274. A top face of the wall-mount bracket 256 includes a horizontal distance scale, generally indicated at 278, extending a substantial length of the top face.

The locking fastener 224 includes an assembly of a screw, generally indicated at 242, and a slider nut 280. The slider nut 280 is operatively disposed on the track 274 between the wall-mount bracket 256 and a head 246 of the screw 242 and adapted to slide continuously and smoothly along the entire track 274. The screw 242 is adapted to be matingly inserted completely through the slider nut 280 from the front of the slider nut 280 and make contact with the sliding part 260. The screw 242 is adapted to be manually tightened so as to secure the sliding part 260 at a desired height of the sliding part 260 above the wall-mount bracket 256 and a desired area along the wall-mount bracket 256. In turn, the screw 242 is adapted to be manually loosened from the sliding part 260 so as to permit the sliding part 260 to quickly and simply slide up, down, and sideway in the aperture of the wall-mount bracket 256 to a new desired position.

It should be appreciated by those having ordinary skill in the related art that the assembly 210, in general, can have any suitable shape, size, and structure. It should be so appreciated also that each of the peg attachment 254, wall-mount bracket 256, hanger hook 258, and locking fastener 224 can have any suitable shape, size, and structure and structural relationship with the remainder of the assembly 210. Like the mounting fastener 24 of the assembly 10, the peg attachment 254 of the assembly 210 is adjustable to any point along both the x- and y-directions.

Preferably, each component of the assembly 10, 110, 210 is made of high-performance nylon and/or polycarbonate. Some parts of the assembly 10, such as the hanger slide 20, can even be made of aluminum and/or steel. Also preferably, each component of the assembly 10, 110, 210 is made using injection-molding processes.

The assembly 10, 110, 210 perfectly places/aligns the picture frame on the wall. Also, the assembly 10, 110, 210 adjusts in two ways (horizontal and vertical) to accommodate imperfections of the picture frame and/or construction of the wall. And, the assembly 10, 110, 210 adjusts in a continuous—rather than a discrete, incremental—manner. Furthermore, the assembly 10, 110, 210 can be manufactured simply and inexpensively and in high volume using low-cost materials—such as high-performance nylon and polycarbonate—and processes—such as injection molding. In addition, the assembly 10, 110, 210 can be easily operated by a person who needs to make a quick and accurate placement of the picture frame (especially a group of same) on an indoor or outdoor wall of a building with a minimum of difficulty. Moreover, the assembly 10, 110, 210 is reusable, versatile, recyclable, and eco-friendly. Plus, the assembly 10, 110, 210 can be universally used—such as in residential and commercial applications; on a picture frame utilizing a wire-, keyhole-, d-ring-, sawtooth-, step-, or general-hole application; and on drywall. The assembly 10, 110, 210 has a robust design, with some parts thereof able to be made of aluminum and/or steel, and is virtually unbreakable as well.

The assembly 10, 110, 210 has been described herein in an illustrative manner. It is to be understood that the terminology that has been used herein is intended to be in the nature of words of description rather than of limitation. Many modifications and variations of the assembly 10, 110, 210 are possible in light of the above teachings. Therefore, within the scope of the appended claims, the assembly 10, 110, 210 may be practiced other than as specifically described herein.

What is claimed is:

1. An adjustable wall-hanger assembly comprising:

a hanger adapted to be secured to a wall and defining an opening of an interior of said hanger, a body section and an upper section extending from said body section, and a top level and a bottom level that are substantially opposed and spaced from and substantially identical with each other such that a space is defined between said levels and said levels are connected with each other along at least one of a closed exterior edge and at least one corner defined by said body section;

a hanger slide movably mounted to said hanger, adapted to slide continuously in either of substantially horizontal and vertical directions in said opening of said hanger, and defining a slot of an interior of said hanger slide extending in the substantially other of said horizontal and vertical directions with respect to said hanger slide;

a mounting fastener received through said slot of said hanger slide and adapted to slide continuously along said slot and be fastened to the wall to mount said assembly to the wall, wherein a combination of said continuous substantially horizontal and vertical sliding of said hanger slide and mounting fastener allows for substantially infinite placement of said mounting fastener in said opening of said hanger; and a hanger hook fixedly connected to and extending outwardly from said hanger and substantially overlying said opening of said hanger for supporting an object hung on said hanger hook.

2. An adjustable wall-hanger assembly as set forth in claim 1, wherein said opening of said hanger is defined in said body section such that said levels and space of said body section outline said opening.

3. An adjustable wall-hanger assembly as set forth in claim 1, wherein said assembly comprises further at least one horizontal distance scale and at least one vertical distance scale.

4. An adjustable wall-hanger assembly as set forth in claim 1, wherein end portions of said hanger slide are securely fitted in said space along, respectively, a top and bottom of said body section such that said end portions are sandwiched between said levels of said hanger and said hanger slide is adapted to slide continuously and smoothly in said opening of said hanger from an interior side of said body section to another interior side of said body section.

5. An adjustable wall-hanger assembly as set forth in claim 1, wherein said mounting fastener includes an assembly of a screw and a washer, said screw is adapted to be inserted completely through said slot of said hanger slide from above said hanger slide and screwed into the wall to mount said assembly to the wall, and said washer is operatively disposed between said hanger slide and a head of said screw.

6. An adjustable wall-hanger assembly as set forth in claim 5, wherein an outer diameter defined by each of said washer and head of said mounting fastener is greater than a width defined by said slot of said hanger slide such that said washer operatively contacts an upper surface of said hanger slide and maintains said head above said hanger slide and said mounting fastener is adapted to slide continuously and smoothly in said slot from an interior end of said hanger slide to another interior end of said hanger slide.

7. An adjustable wall-hanger assembly as set forth in claim 1, wherein said hanger hook includes a stem portion and a head portion disposed atop said stem portion, said stem portion extends outwardly a desired distance from said upper section of said hanger, and said head portion is adapted to support a picture frame hung on said hanger hook.

8. An adjustable wall-hanger assembly as set forth in claim 7, wherein said head portion of said hanger hook defines a groove extending about a circumferential surface of said head portion such that when said assembly is mounted to the wall, a substantially upper half of said groove is adapted to operatively receive a part that is secured to the picture frame and used to hang the picture frame upon said assembly.

* * * * *